US005868547A

United States Patent [19]

Cohn

[11] Patent Number: 5,868,547

[45] Date of Patent: Feb. 9, 1999

[54] STRIPPING AND TRANSFER ASSEMBLY FOR FOOD INTERLEAVING APPARATUS

[76] Inventor: Robert Cohn, 1210 Jackson St., Omaha, Nebr. 68102

[21] Appl. No.: 432,568

[22] Filed: May 1, 1995

Related U.S. Application Data

[63] Continuation-in-part of Ser. No. 53,430, Apr. 28, 1993, Pat. No. 5,419,677.

[51] Int. Cl.[6] ..... B65G 47/52

[52] U.S. Cl. ..... 414/789.5

[58] Field of Search ..... 198/723, 462.2, 198/418.9, 635, 599; 414/789.5

[56] References Cited

U.S. PATENT DOCUMENTS

| | | | |
|---|---|---|---|
| 3,272,309 | 9/1966 | Reading | 198/723 |
| 3,870,139 | 3/1975 | Wagner . | |
| 4,041,676 | 8/1977 | Smithers | 198/462.2 |
| 4,532,751 | 8/1985 | Mally et al. . | |
| 4,690,269 | 9/1987 | Takao . | |
| 4,852,717 | 8/1989 | Ross et al. . | |
| 5,051,268 | 9/1991 | Molly | 198/462.2 |
| 5,145,306 | 9/1992 | Foster et al. | 198/635 |
| 5,174,431 | 12/1992 | Abler | 198/462.2 |

FOREIGN PATENT DOCUMENTS

| | | | |
|---|---|---|---|
| 3444132 | 6/1986 | Germany | 198/635 |

*Primary Examiner*—Karen M. Young
*Assistant Examiner*—Gregory A. Morse
*Attorney, Agent, or Firm*—Evelyn M. Sommer

[57] ABSTRACT

A stripping and transfer assembly for a food product interleaver apparatus includes a conveyor having an endless-type conveying surface formed with raised ribs spaced apart in parallel, a comb member having a plurality of teeth inserted between the raised ribs at the downstream end of the conveyor and curved surfaces for lifting off food product units from the conveyor, and a rotatable transfer wheel positioned above the comb member having a flexible outer annular contact surface for lightly engaging food product units lifted off by the comb member and moving them to a drop-off point onto a carrier sheet. Preferably, the transfer wheel is made of an elastic material and has radial spokes extending at an inclined angle to the outer annular contact surface for promoting radial deformation of the transfer wheel. The relative positions of the comb member and transfer wheel can be adjusted optimally.

3 Claims, 8 Drawing Sheets

STRIPPING AND TRANSFER ASSEMBLY FOR FOOD INTERLEAVING APPARATUS

This patent application is a continuation-in-part of U.S. Patent Application 08/053,430 of the same inventor filed on Apr. 28, 1993 , 1993, entitled Apparatus and Method for Programmable Interleaving and Stacking of Sheet Carried Food Products", now issued as U.S. Pat. No. 5,419,677.

FIELD OF THE INVENTION

The invention relates to apparatus for interleaving sliced food product units on a carrier sheet during continuous, high-speed conveying of the sliced food product units on a conveyor.

BACKGROUND ART

Apparatus used for packaging bacon, cold cuts, and other types of sliced food products into output packaged units typically convey the sliced food products from an upstream food processing station, such as a slicer, cooking oven, and the like, to an interleaving station where a carrier sheet is positioned to receive the sliced food products in overlapping or shingled arrangement thereon. When a predetermined number of sliced food products have been arranged on the carrier sheet, the output unit is transferred to a downstream wrapping or stacking station for output packaging.

Prior interleaving apparatus have generally used controls to deposit the sliced food products on a conveyor in groups separated by gaps or to halt the conveying of food products as each group of food products is conveyed to a receiving station to be deposited on a carrier tray or other transport member. For example, in U.S. Pat. No. 4,532,751 to Mally et al., the food products are deposited on a supply conveyor separated by gaps between groups, and when a detector detects a gap in the food products, an interleaver control cuts the trailing edge for a current carrier sheet and advances it from the receiving station while advancing the leading edge for the next carrier sheet to the receiving station. The conventional equipment has limitations in that it cannot accept food products that are randomly or continuously arranged on the conveyor, nor can it properly handle food products where the spacing between products or the gap between groups of food products are not precisely maintained.

Other food packaging systems, such as shown in U.S. Pat. No. 4,690,269 to Takao, and U.S. Pat. No. 4,852,717 to Ross et al., have controlled the speed of a downstream receiving conveyor for receiving a number or group of food articles in response to detection of the food articles on an upstream supply conveyor so that the articles can be accurately transferred in groups in a desired spaced relation even though the articles may not be a constant distance apart on the food supply conveyor. U.S. Pat. No. 3,870,139 to Wagner teaches the concept of operating the receiving conveyor at a lower speed than the supply conveyor to receive food articles in a shingled arrangement thereon, then operating it at a higher speed to advance a deposited shingled group to an output. However, the prior systems have not satisfactorily provided for the automatic interleaving of carrier sheets cut from a roll to receive food products supplied randomly or continuously on a supply conveyor, nor for automatic stacking of a number of output units of sheet-carried sliced food products for final packaging.

In my copending prior U.S. patent application referred to above, an apparatus and method for interleaving a carrier sheet with food product units thereon has a supply conveyor for continuously conveying food product units with random spacings therebetween, a delivery section for continuously delivering units from the supply conveyor to a drop-off point, a source for supplying carrier sheets to receive units thereon, a detector for detecting the passage of the units past a predetermined position from the drop-off point, an indexing conveyor for moving each carrier sheet to receive the units at the drop-off point in timed relation to their arrival there, a counter for counting down the arrival of each detected unit to the drop-off point, and a programmable controller for controlling the indexing conveyor to advance the carrier sheet incremental amounts at the drop-off point for receiving each unit in timed relation to their detection, count-down, and arrival at the drop-off point.

SUMMARY OF THE INVENTION

The present invention is directed to a further improvement of a stripping and transfer assembly for a food product interleaver apparatus. A principal object is to provide an assembly which can accurately and reliably strip food product units from a conveyor without crumpling them and transfer them to the drop-off point for arrangement on a waiting carrier sheet.

In accordance with the present invention, a stripping and transfer assembly for a food product interleaver apparatus having a conveyor for conveying food product units to a drop-off point onto a carrier sheet positioned at a downstream end of the conveyor, comprises: the conveyor having an endless-type conveying surface formed with ribs extending in parallel spaced apart from each other in a transverse direction, a comb member positioned between the downstream end of the conveyor and the drop-off point, said comb member having a plurality of teeth extending in parallel spaced apart in the transverse direction with a spacing matched to that of the conveyor ribs, the teeth being inserted in the spacings between the conveyor ribs at the downstream end of the conveyor, and curved surfaces extending to a drop-off end of the comb member, and a rotatable transfer wheel positioned above the comb member having a flexible outer annular contact surface for lightly engaging food product units stripped by the comb member and moving them past the drop-off end thereof for dropping off onto the carrier sheet.

In a preferred embodiment, the transfer wheel is formed of an elastic material and has radial spokes extending at an inclined angle to the outer annular contact surface for promoting radial deformation of the transfer wheel. The outer annular contact surface has a plurality of transverse ridges spaced circumferentially thereon for gripping the food product units. The relative positions of the comb member and transfer wheel can be adjusted for optimal use.

Other objects, features and advantages of the present invention are described in greater detail below in conjunction with the drawings.

DETAILED DESCRIPTION OF THE INVENTION

Figure 1:
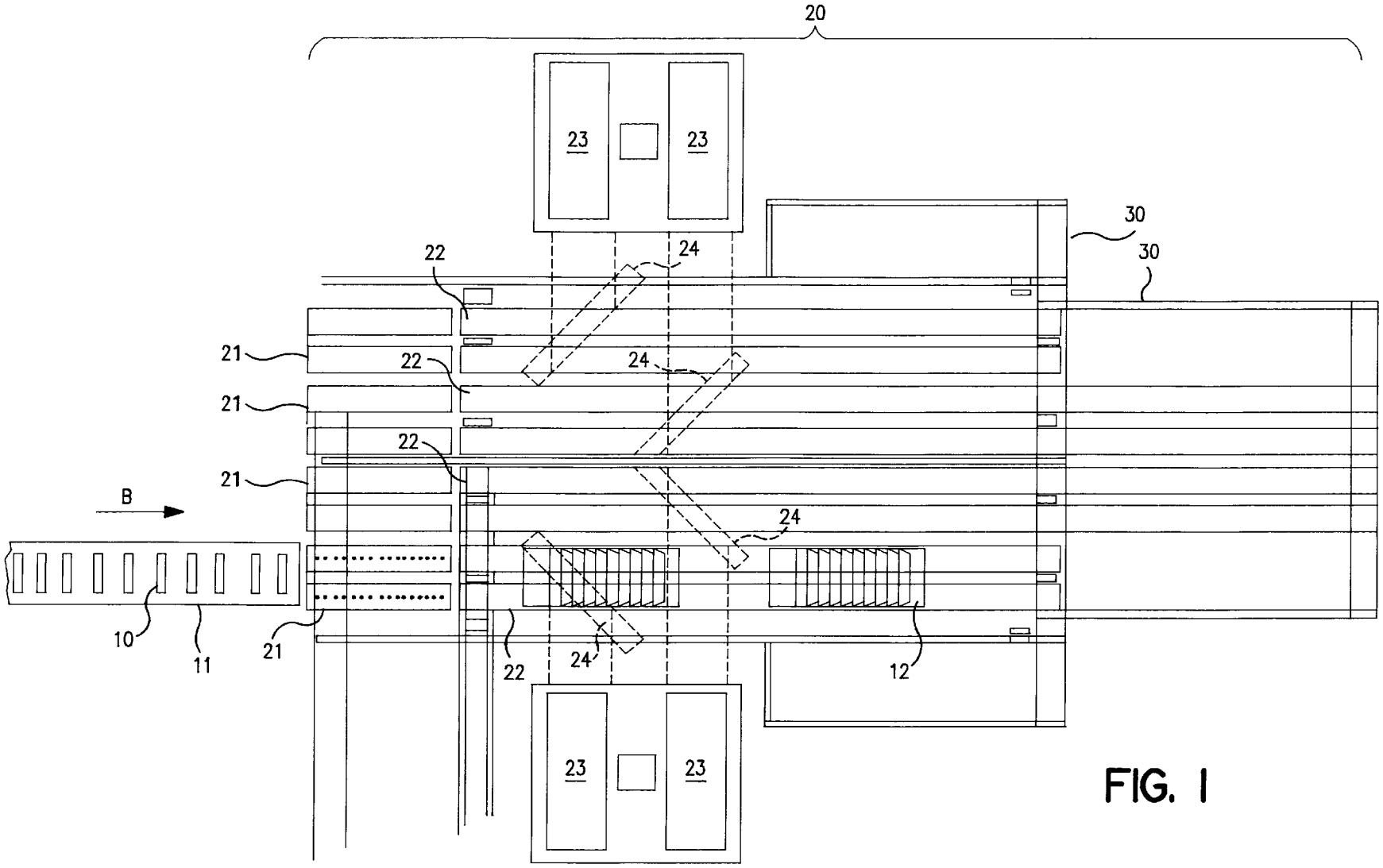
FIG. 1 shows a plan view of a typical interleaving station for interleaving food product units on carrier sheets.

Referring to FIGS. 1–4, a preferred embodiment of a programmed interleaving apparatus is shown for automatically placing randomly or continuously conveyed sliced food product units such as bacon strips on cut carrier sheets. The bacon strips are to be placed in uniformly spaced shingled arrangement or any other desired pattern on the carrier sheet. As shown in FIG. 1, the equipment is built to take cooked bacon strips 10 conveyed continuously on a supply conveyor 11 in the direction of arrow "B" from an upstream food processing station (not shown) such as a slicer, cooker, and the like. More than one supply conveyor may be used or, alternatively, the bacon may be sliced and laid on a single extra-wide supply conveyor in multiple columns. As the bacon strips are conveyed on the supply conveyor 11, human inspectors or computerized monitors may remove pieces that are not salable because of incorrect size or condition. This would leave gaps and varying spaces between good slices resulting in irregular arrangement on the supply conveyor 11 from time to time.

Interleaving Station

The interleaving station 20 has a delivery section 21 to receive the continuously conveyed bacon strips and a sheet transport section 22 for advancing cut paper sheets from a roll to receive the bacon strips thereon. For a system which has multiple incoming lines or columns of bacon strips, a corresponding number of delivery sections 21 and sheet transport sections are provided. The paper sheets for the respective interleaving lines are provided from paper rolls housed in unwind stands 23 and turned through ninety degress on turn bars 24 into alignment with the interleaving lines. The output units 12 of sheet-carried bacon strips are then transferred from an output section 30 to a stacking station (to be described further below).

Figure 2:
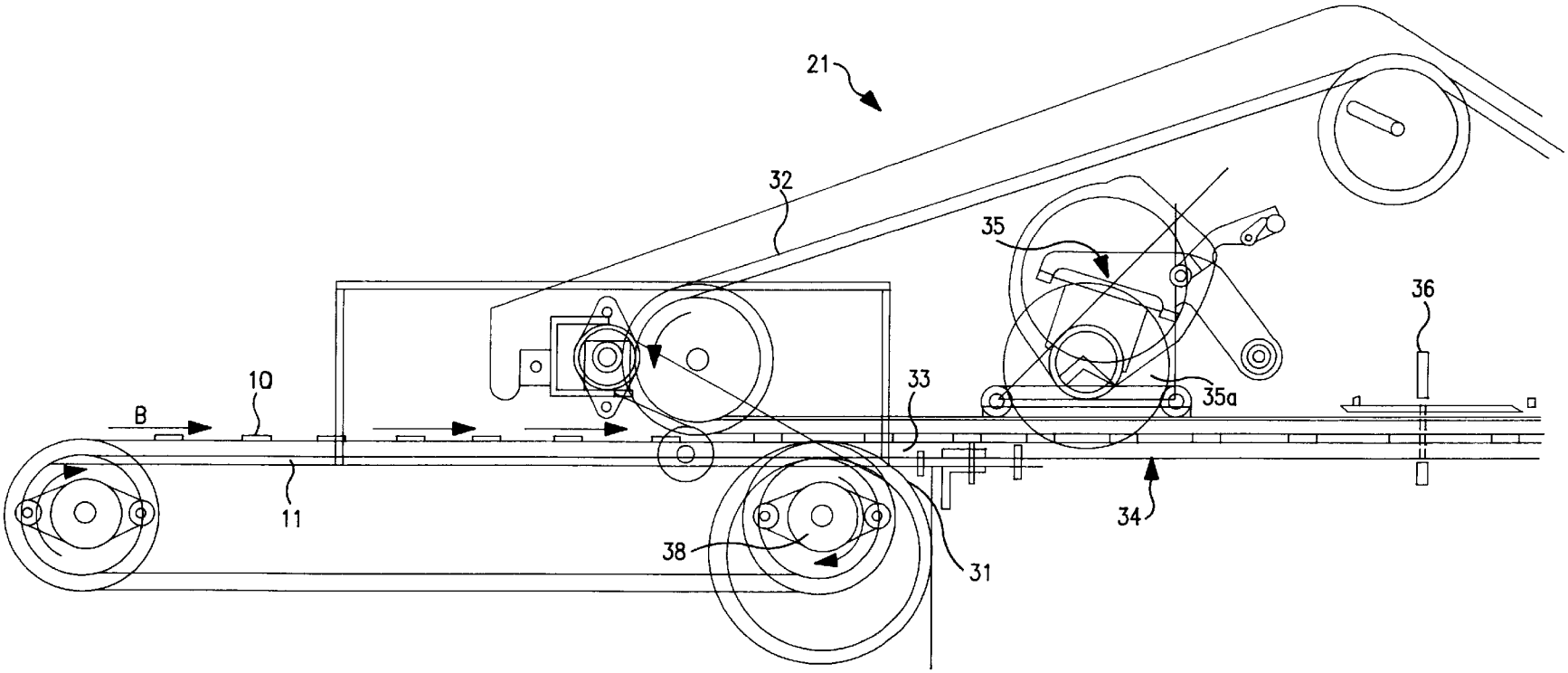
FIG. 2 shows a side schematic view of an input end of the interleaving station of FIG. 1.

Referring to FIG. 2, as the bacon strips 10 are transported in the direction of the arrow "B" from the supply conveyor 11 to the delivery section 21 for the interleaving station, they are raised off the conveyor 11 on a raised rib of a separation member 31 and moved by an upper traction belt 32 over a comb 33 so that they are stripped from the conveyor 11 and moved along a bridge plate 34. The separation member may be a commercial unit, for example, as sold under the tradename Intralox Series 900 by Intralox, Inc., located in Harahan, Louisiana. The delivery section 21 can include a splitter assembly 35 composed of a mounting, motor, and a circular knife 35a for cutting the input bacon strip into smaller pieces, as may be desired for certain uses such as fast foods, etc. The circular knife 35*a* cuts through a slot in the bridge plate 34.

Figure 3:
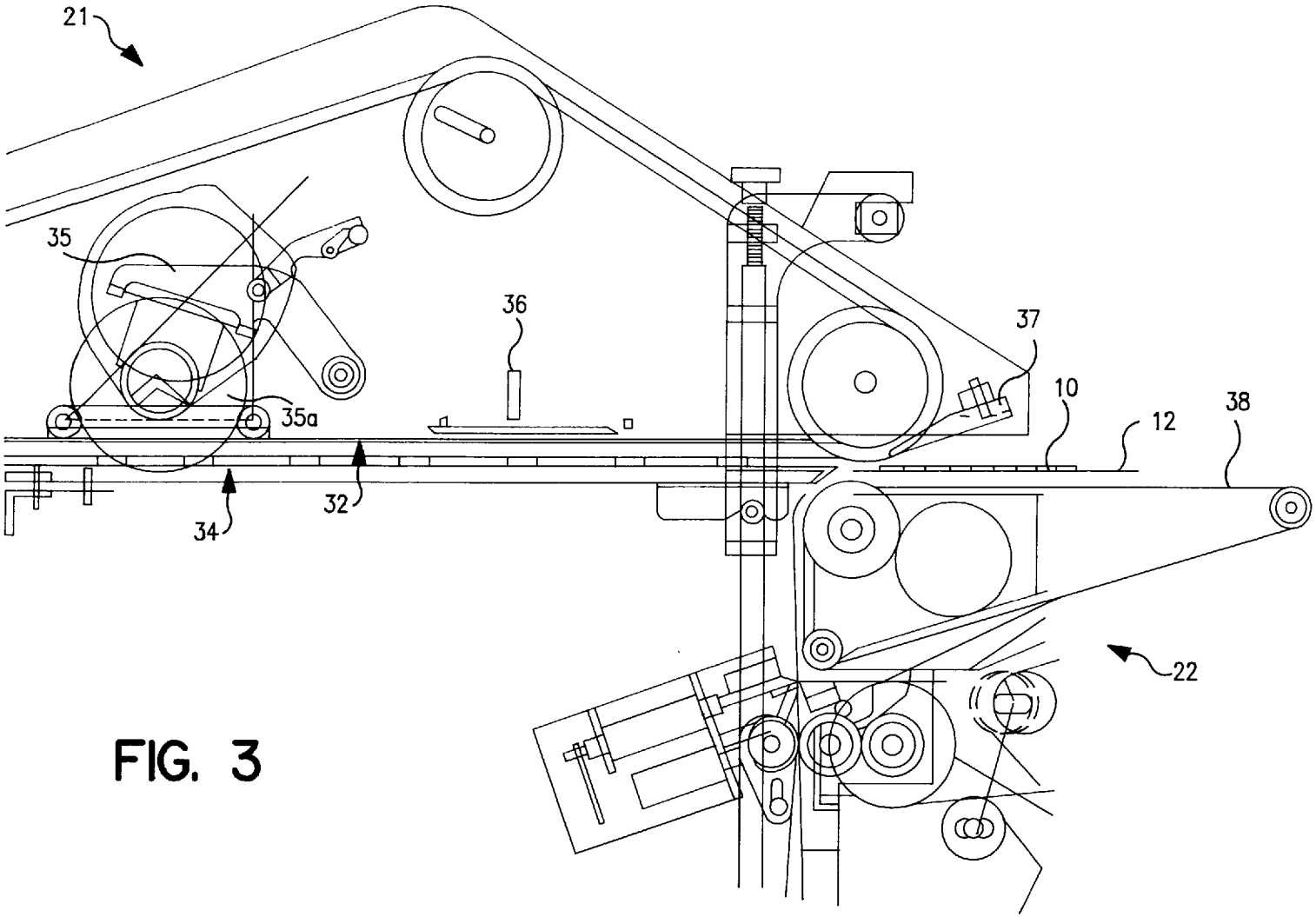
FIG. 3 shows a side schematic view of an output end of the interleaving station.

As shown in FIG. 3, the delivery section 21 has an optical sensor 36 which detects each bacon strip 10 as it passes along the bridge plate 34. The sensor 36 is connected to a shift register circuit which counts down the distance for transport of the bacon strip 10 to the end of the delivery section 21 based upon its detected position and the distance and speed it is moved by the traction belt 32. At the output end of the delivery section 21, a comb 37 positively removes the bacon strip 10 from the belt 32 where it, drops onto a carrier sheet 12 positioned to receive a predetermined number of the bacon strips.

Figure 4:
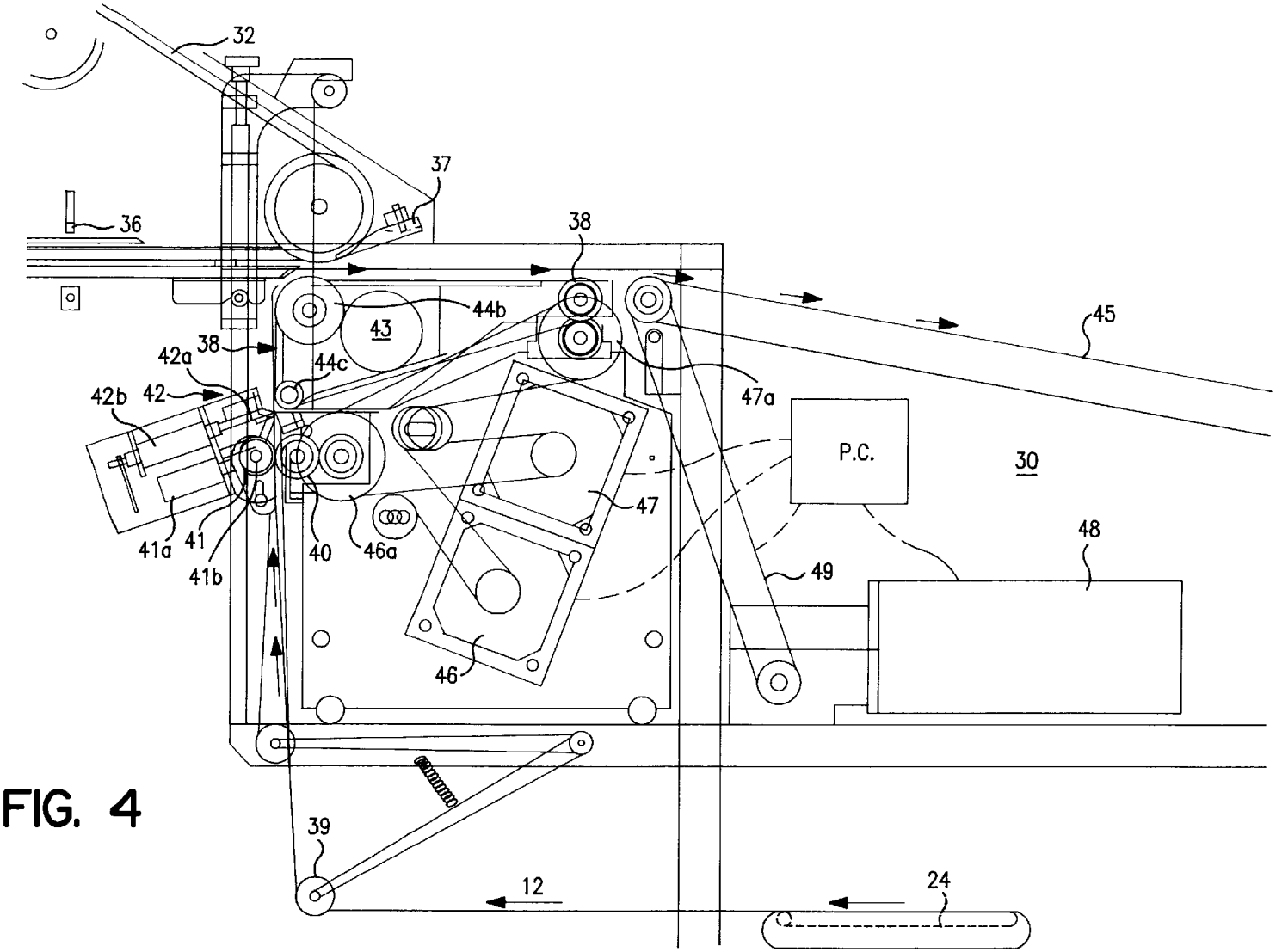
FIG. 4 shows a side schematic view of a sheet transfer section for the interleaving station.

As shown in greater detail in FIG. 4, the carrier sheet 12 is held by vacuum force on a programmably indexed conveyor 38 of the sheet transport section 22. The paper unwound from the unwind stand 23 and turned on the turn bar 24 is pulled over a spring-biased roll 39 up between a draw roll 40 and pinch roll 41 (indicated by the arrows in FIG. 4). Pinch roll 41 is a 60-durometer, resilient plastic roll (U.S.D.A. approved) that is friction driven by draw roll 40. Pressure for friction driving of the paper between the rolls 40 and 41 is provided by two pressure-regulated air cylinders 41*a* pushing on a bearing retainer that pivots the shaft 41*b* supporting the pinch roll 41.

The paper continues upward past the knife 42 having a stationary part and a moveable part. The moveable part 42*a* is activated by two air cylinders 42*b*. The moveable part 42*a* is tensioned against the stationary part in order to cut the paper by a scissor action when the cylinders 42*b* are activated. The cut paper sheet is held to the conveyor 38 by vacuum force and advanced under the drop-off point for the bacon strips in accordance with an indexing control to be described further herein. Vacuum pressure is provided within the internal space of the conveyor 38 from a duct 43 to a vacuum source, and the belt 38 has perforations for holding the sheet against the belt. When a sheet has been loaded with the predetermined number of bacon strips from the delivery section 21, the conveyor 45 is driven at an elevated speed to advance the sheet with loaded bacon in output section 30. The output conveyor is driven by a drive motor 48 through a drive belt 49.

The vacuum conveyor assembly includes a drive roll 44*a* and two idler rolls 44*b*, 44*c*. The drive roll 44*a* has teeth cut for ⅕ pitch timing belts. The idler rolls do not have timing belt teeth, but have radial slots cut under the position of the conveyor belt 38 so that vacuum pressure in the internal housing can communicate around the rolls. When multiple interleaver lines are arranged side to side, vacuum pressure is passed through the side frames of the vacuum housings through the hole 43. The vacuum is supplied by a low pressure blower creating a vacuum pressure of about one-inch water column.

A servo motor located at position 46 or 47 is indexed to pull a tensioned belt entrained around idler pulleys to drive the driven pulley 46*a* which drives the draw roll 40 to advance the paper to the vacuum conveyor 38. The servo motor is also indexed to pull a tensioned belt entrained around idler pulleys to drive the driven pulley 47*a* which drives the drive roll 44*a* to advance the conveyor belt 38. The conveyor belt 38 is driven at a slightly faster speed than the paper to keep a certain amount of draw tension on the paper. The servo motors, cylinder actuators, and drive motors for the conveyor belts are all connected to a programmable controller (P.C.) for overall control of the system.

In actual operation, bacon strips are advanced continuously with a spacing that may be random and taken from the supplier conveyor 11 by the delivery section 21. The passage of each bacon strip is detected by the optical sensor 36, which signals a shift register in a programmable controller circuit to count down the distance of the bacon piece toward the drop-off point to the vacuum conveyor 38. For example, a magnetic pickup on a drive shaft for the traction belt 32 can be used to provide an incremental belt movement signal for counting down. The shift register is thus used to retain a positive location of the bacon piece until the drop-off point.

As or just before the bacon piece drops off onto the sheet on the conveyor belt 38, the servo motor located at 46 or 47 indexes the draw roll 40, the paper, and the conveyor belt 38 a specific programmed amount for precisely locating the bacon piece on the sheet. For example, the sheet can be indexed a uniform amount less than the width of the bacon piece to arrange the pieces on the sheet in overlapping, shingled fashion. Alternatively, any desired pattern of arrangement on the sheet may be implemented by suitable programming of the indexing sequences. This stepwise indexing continues until a specified number of pieces are placed on the paper, then the program control activates the knife cylinders 42*b* to cut the paper, and also drives the drive roll to advance the laden sheet to the output conveyor 45 while at the same time advancing the leading (cut) edge of the paper in position to receive the next specified number of bacon pieces at the drop-off point. With this mode of operation, the spacings between bacon pieces on the supply conveyor do not have to be uniform nor driven at a constant speed differential relative to the traction belt 32 or the vacuum conveyor belt 38. Instead all adjustments for placing the bacon pieces on the carrier sheet are made by counting down the precise location of each piece to the drop off point and programmed control of the sheet indexing.

Figure 5:
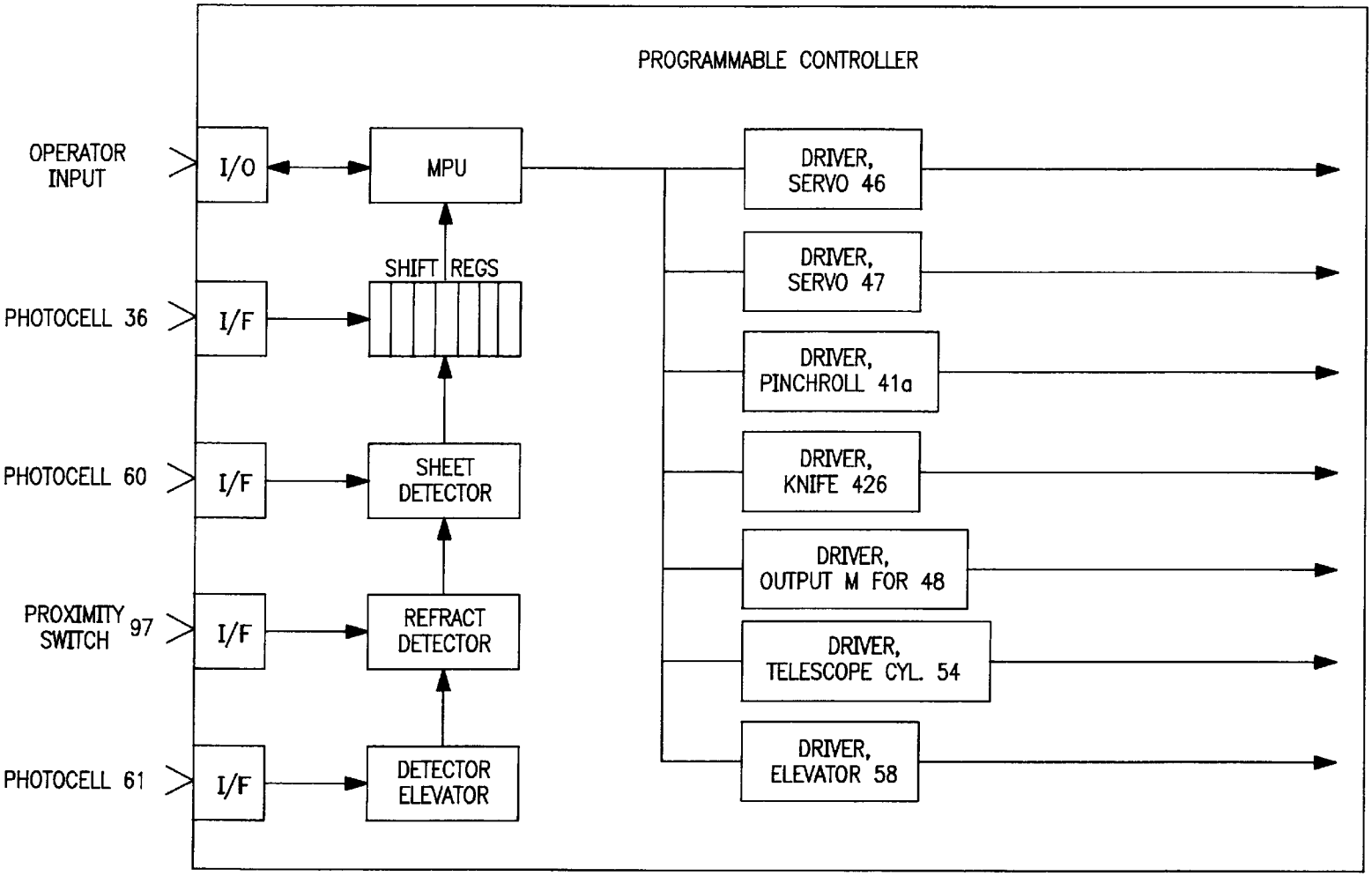
FIG. 5 illustrates components of a programmable controller for the interleaving station.

FIG. 5 illustrates schematically the components of a programmable controller for the interleaving station. The programmable controller P.C. is implemented with known programming techniques and controller components. The controller includes inputs from the operator and the sensors used in the system, a microprocessor (MPU) for performing the interleaving program, shift registers for counting down the drop-off of bacon pieces, and outputs to drivers for the actuatable components of the system.

In actual operation, the operator initially provides an input to the programmable controller to open the pinch roll for the carrier sheet. The operator can then thread the leading end of a sheet into the sheet feeding and cutting section. Another operator input then causes closing of the pinch roll, and initiation of the P.C. program which starts conveyor motor 48 to advance the sheet. Under P.C. program control, the system cuts the paper and advances the cut paper edge to the drop off point. The system then waits for an input from photocell 36 indicating detection of a bacon slice on the conveyor 11. Upon a detection signal from photocell 36, the shift register starts to count down based upon a distance-travelled signal provided from the magnetic pickup for the belt 32. The shift register counts down and activates the driver for the servo motor to advance the paper a programmed incremental amount. Successive signals from the photocell 36 similarly activates each of the programmed indexing steps. When a prescribed number of units have been counted, the knife assembly cuts the paper, the laden paper is advanced from the drop-off station, and the program repeats for the next loading sequence.

Stripping and Transfer Assembly

Figure 6B:
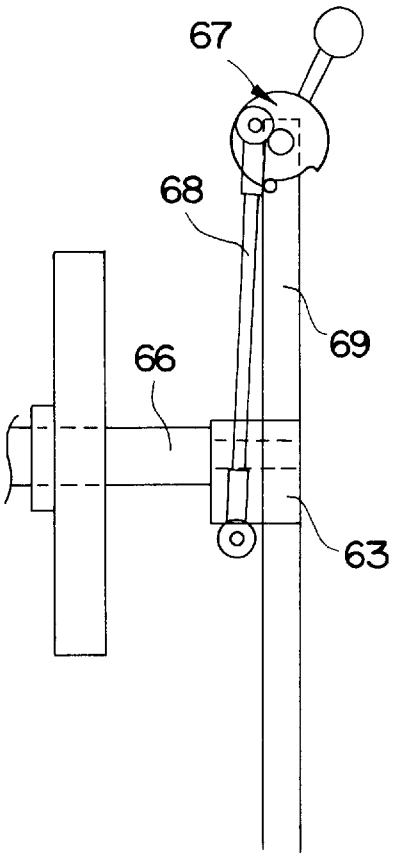
FIGS. 6*a* and 6*b* are schematic side and front views of a stripping and transfer assembly for the interleaving station.
Figure 6A:
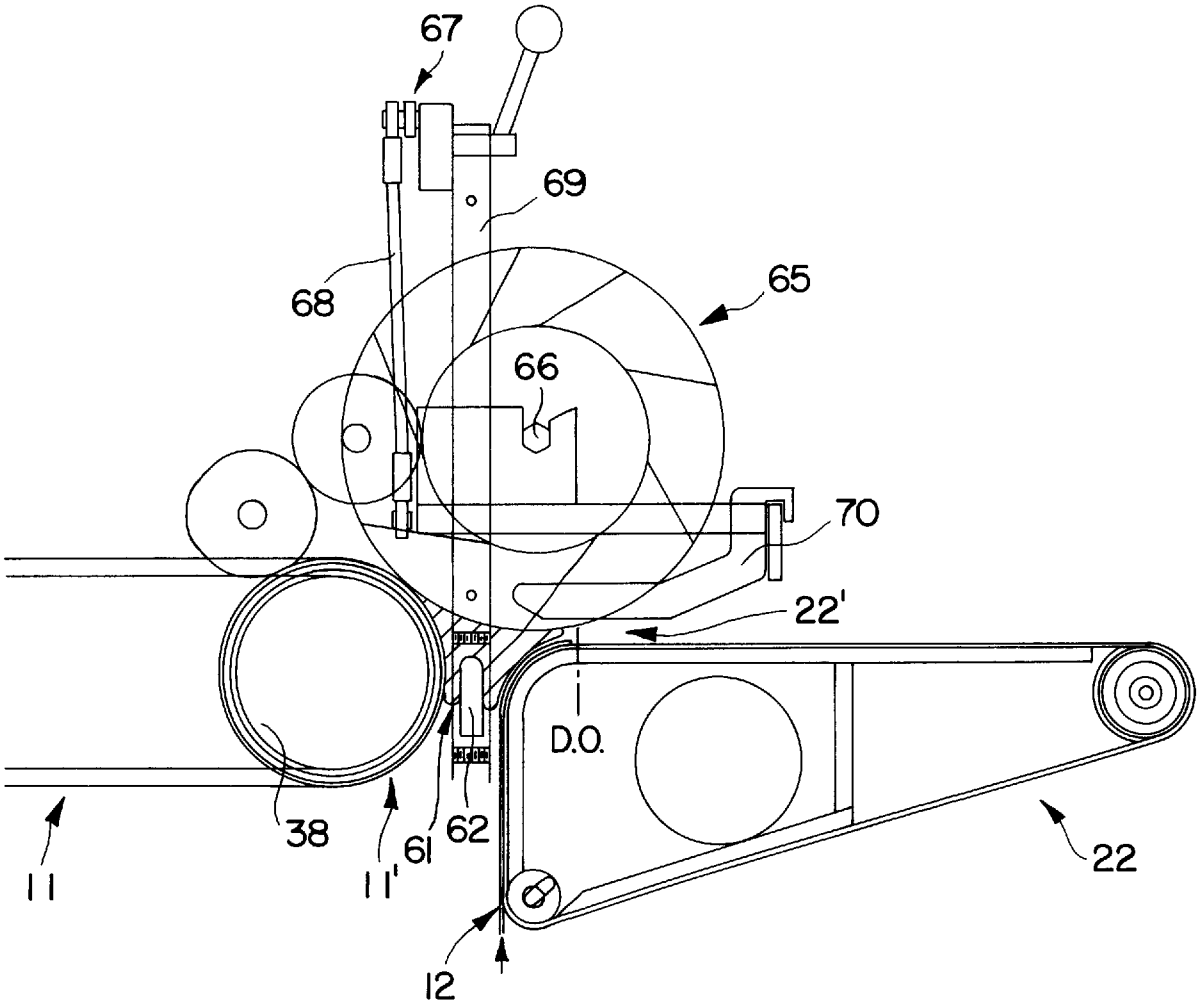

As shown in FIGS. 6–8, a preferred stripping and transfer assembly is used in place of the output end of the delivery section 21 shown in FIGS. 2 and 3. Instead, the conveyor 11 is lengthened so that its downstream end 11' is proximate the drop-off point "D.O.". The delivery section 21 may be omitted or may be used in tandem above the conveyor 11 with its downstream end terminating ahead of the downstream end 11' of the conveyor 11. A comb member 61 and a rotatable transfer wheel 65 are positioned between the downstream end 11' of the conveyor 11 and the upstream end 22' of the sheet transport section 22 for stripping the food product units from the conveyor surface and transferring them to the drop-off point D.O. for arrangement on a carrier sheet 12.

Figure 7B:
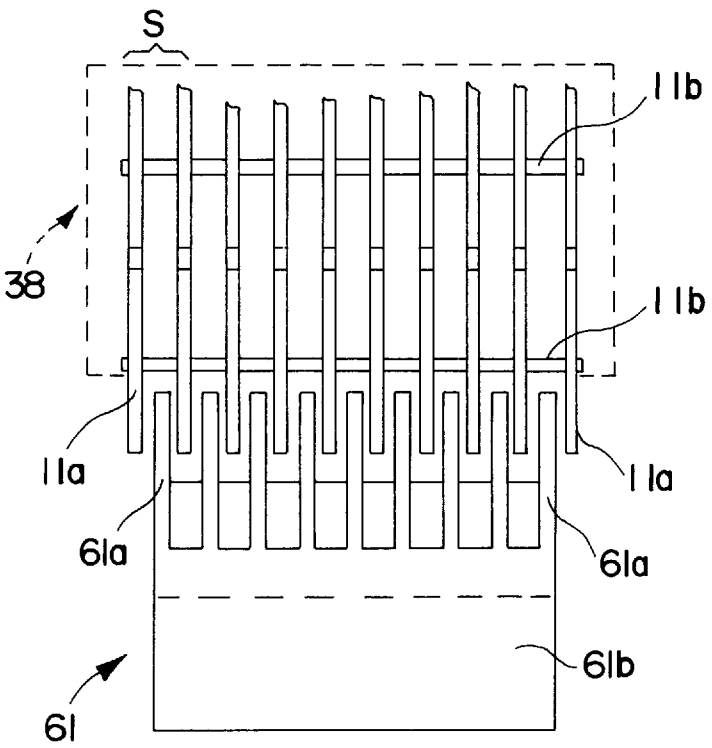
FIGS. 7*a* and 7*b* are side and plan views of a preferred embodiment of a comb member for the stripping and transfer assembly.
Figure 7A:
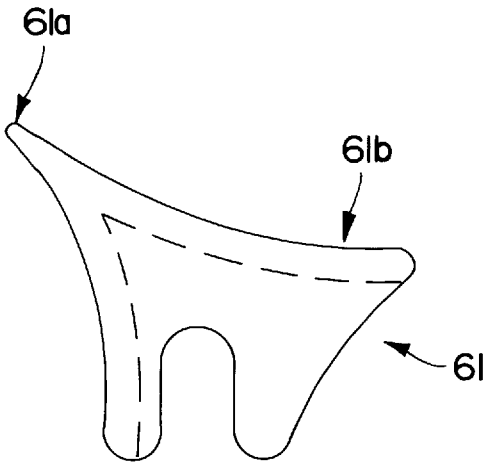

Referring to FIGS. 7*a* and 7*b*, the preferred stripping and transfer assembly is used with a conveyor having an endless-type conveying surface formed by raised rib sections 11*a* which are coupled together in chain-link fashion and supported from below by transverse bars 11*b* so as to form a stable conveying surface. The raised rib sections 11*a* extend in parallel in the conveying direction and are spaced apart from each other by a conveyor rib spacing "S" in the transverse direction. Such a raised-rib conveyor can be obtained commercially under the tradename Intralox Series 900 by Intralox, Inc., located in Harahan, Louisiana.

The comb member 61 has a plurality of teeth 61*a* extending in parallel which are spaced apart in the transverse direction with a spacing matched to the conveyor rib spacing S. The teeth 61*a* of the comb member 61 are inserted in the spacings between the conveyor ribs at the downstream end of the conveyor and have curved surfaces extending to the drop-off end 61*b* thereof for lifting food product units off from the conveying surface of the conveyor 11. The curved surfaces of the comb member 61 have a curvature matched to the curvature of the outer annular contact surface of the transfer wheel 65. The comb member 61 is positioned with its teeth interdigitated between the raised ribs 11*a* of the conveyor surface so as to coincide with the tangency point between the conveyor sprocket 38 and the transfer wheel 65. The comb member is mounted in place on a support bar 62 on the stanchion 69.

Figure 8B:
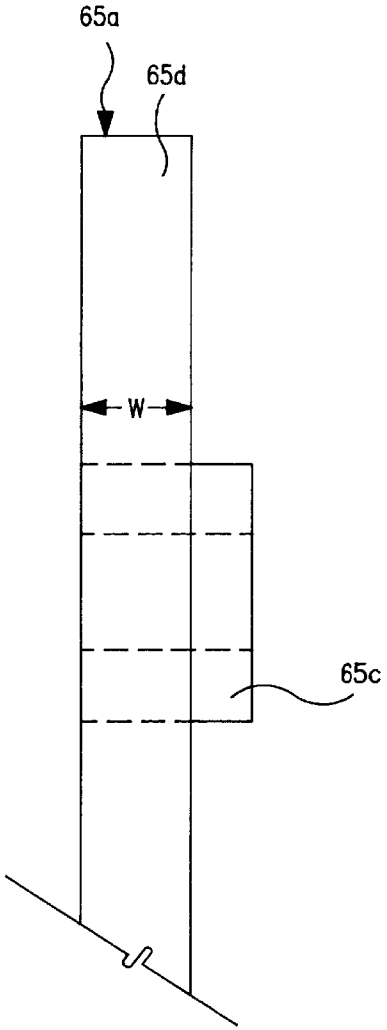
FIGS. 8*a* and 8*b* are side and front views of a preferred embodiment of a transfer wheel for the stripping and transfer assembly.
Figure 8A:
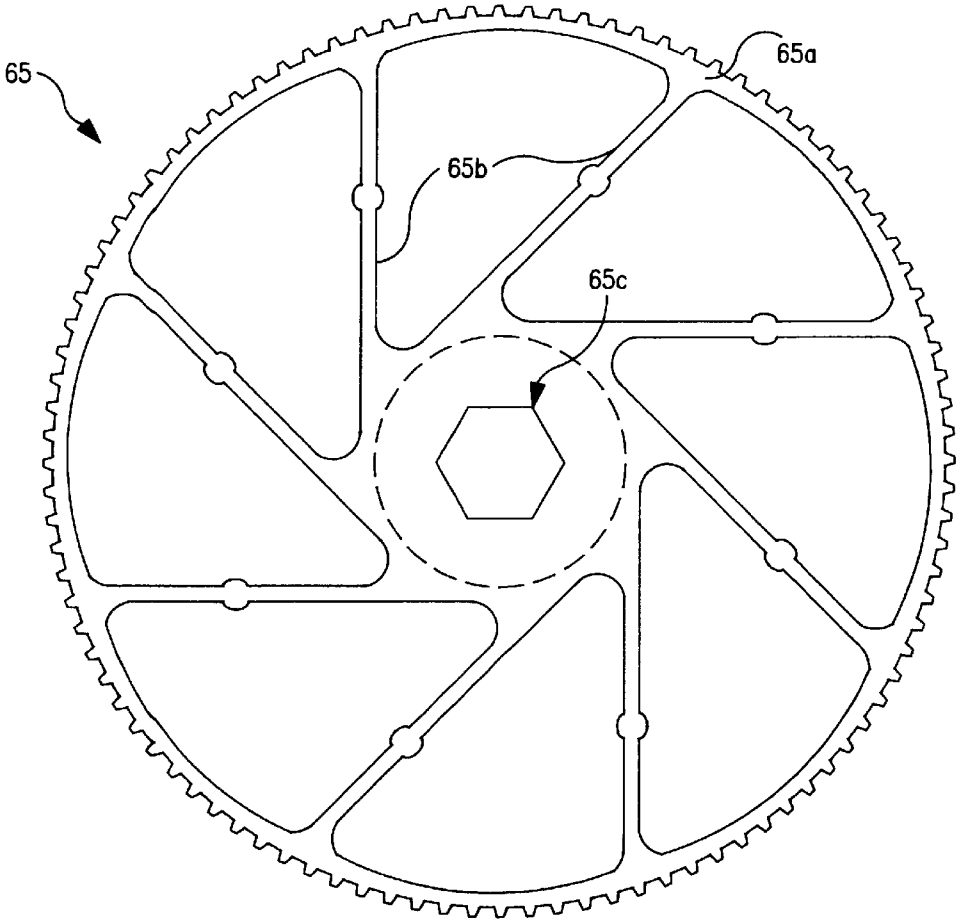

As shown in FIGS. 8*a* and 8*b*, the rotatable transfer wheel 65 positioned above the comb member 61 has an outer annular contact surface 65*a* and radial spokes 65*b* extending at an inclined angle from its center axis at hex hub 65*c* to the outer annular contact surface 65*a*. The transfer wheel is preferably made of an elastic material such as one known under the designation "Sanoprene", which has an elasticity of 50–55 durometer. The elastic construction and the angled spokes promote the radial deformation of the outer annular contact surface of the transfer wheel to ensure that it remains in light wiping contact with the comb member regardless of the thickness or orientation of the food product units. The hex hub 65*c* is simply mounted on a hex shaft 66 so that no clamps or set screws are needed to hold it in place. The outer annular contact surface 65*a* of the transfer wheel preferably is formed with a plurality of transverse ridges 65*d* spaced circumferentially thereon for gripping of the food product units. The transfer wheel can have any width "W" suitable for gripping and moving the food product units.

The transfer wheel 65 is adjustable positioned on the stanchion 69 by an eccentric cam 67 and linkage 68 by coupled to a bearing block 63 holding the hub 66. The transfer wheel is elevated at a preferred angular position of approximately 50° to the horizontal from the center of the conveyor sprocket 38. It is spaced above the comb member 61 so that its outer annular contact surface 65*a* is in light wiping contact with or has a slight clearance to about 1/32 inch from the curved surfaces of the comb teeth 61*a*. The transfer wheel is rotated by hex hub 66 at a speed comparable to or perhaps slightly higher or lower than the conveying speed of the food product units in order to accelerate or decelerate the food product units from the convyeor depending upon the motion characteristics desired. A stripper guide 70 positioned slightly away from the drop-off end 61*b* of the comb member 61 ensures that the food product units are moved from the transfer wheel to the drop-off point D.O.

Although the invention has been described with reference to certain preferred embodiments, it will be appreciated that many other variations and modifications thereof may be devised in accordance with the principles disclosed herein, and may be adapted to other types of products to be carried on a sheet. It is intended that the described embodiments and all variations and modifications thereof within the scope and spirit of the invention be included within the following claims.

I claim:

1. A stripping and transfer assembly for a food product interleaver apparatus having a conveyor for conveying food product units in a conveying direction to a carrier sheet at a drop-off point proximate a downstream end of the conveyor, comprising:

said conveyor having an endless-type conveying surface formed with ribs extending in parallel in the conveying direction which are spaced apart from each other by a given conveyor rib spacing in a direction transverse to the conveying direction;

a comb member positioned between the downstream end of the conveyor and the drop-off point, said comb member having a plurality of teeth extending in parallel to the conveying direction which are spaced apart in the transverse direction with a spacing matched to that of the conveyor rib spacing, wherein the teeth of said comb member are inserted in the spacings between the conveyor ribs at the downstream end of the conveyor and have curved surfaces extending to a drop-off end of the comb member for lifting off food product units from the conveying surface of the conveyor; and a rotatable transfer wheel adjustably positioned (i) from a stanchion by an eccentric cam and linkage coupled to a bearing block holding a hub for the transfer wheel, and (ii) above the comb member having a flexible outer annular contact surface for lightly engaging food product units lifted off by the comb member from the conveying surface of the conveyor and moving them past the drop-off end of the comb member for dropping off onto the carrier sheet.

2. A stripping and transfer assembly for a food product interleaver apparatus having a conveyor for conveying food product units in a conveying direction to a carrier sheet at a drop-off point proximate a downstream end of the conveyor, comprising:

said conveyor having an endless-type conveying surface formed with ribs extending in parallel in the conveying direction which are spaced apart from each other by a given conveyor rib spacing in a direction transverse to the conveying direction;

a comb member positioned between the downstream end of the conveyor and the drop-off point, said comb member having a plurality of teeth extending in parallel to the conveying direction which are spaced apart in the transverse direction with a spacing matched to that of the conveyor rib spacing, wherein the teeth of said comb member are inserted in the spacings between the conveyor ribs at the downstream end of the conveyor and have curved surfaces extending to a drop-off end of the comb member for lifting off food product units from the conveying surface of the conveyor;

a rotatable transfer wheel positioned above the comb member having a flexible outer annular contact surface for lightly engaging food product units lifted off by the comb member from the conveying surface of the conveyor and moving them past the drop-off end of the comb member for dropping off onto the carrier sheet; and a stripper guide positioned adjacent to the transfer wheel slightly away from the drop-off end of the comb member to ensure that the food product units are removed from the transfer wheel to the drop-off point.

3. The apparatus of claim 2 wherein the food product comprises meat.

* * * * *